United States Patent [19]

Borne et al.

[11] 4,413,876

[45] Nov. 8, 1983

[54] FAIL-SAFE ELECTRICAL CONNECTION TERMINAL AND TIGHTENING TOOL

[75] Inventors: André Borne, Villeurbanne; Joseph Vallod, Caluire et Cuire; René Curvat, Rillieux La Pape, all of France

[73] Assignee: Societe Anonyme dite: Cgee Alsthom, Levallois-Perret, France

[21] Appl. No.: 307,552

[22] Filed: Oct. 1, 1981

[30] Foreign Application Priority Data

Oct. 2, 1980 [FR] France ..... 80 21114

[51] Int. Cl.[3] ..... H01R 4/30

[52] U.S. Cl. ..... 339/244 B; 339/248 R; 339/272 B; 411/429; 411/910

[58] Field of Search ..... 339/244 B, 248, 255 R, 339/272 B; 411/402, 407, 429, 910

[56] References Cited

U.S. PATENT DOCUMENTS

| | | | |
|---|---|---|---|
| 2,148,960 | 2/1939 | Peirce | 339/244 B |
| 3,889,490 | 6/1975 | Nadolny | 81/52.4 R |
| 4,147,446 | 4/1979 | Frank | 339/244 B |

FOREIGN PATENT DOCUMENTS

| | | | |
|---|---|---|---|
| 927020 | 3/1955 | Fed. Rep. of Germany . | |
| 646842 | 7/1928 | France | 411/429 |

*Primary Examiner*—John McQuade
*Assistant Examiner*—Paula Austin
*Attorney, Agent, or Firm*—Sughrue, Mion, Zinn, Macpeak and Seas

[57] ABSTRACT

A terminal comprises a slotted bolt (7), and a cap (10) therefor. The cap has one end closed by a plate (14) with two lugs (11,12) projecting perpendicularly from the periphery of the plate (14) and a central boss (13) with two plane faces (18) opposite the gaps between the lugs. The plane faces have hooks (58) reaching part of the way up them, and the end of the boss beyond the hooks is polygonal. The tool includes a torque limiter (25), a casing (28), and a drive member (29) passing through the casing and made fast to the torque limiter. The casing has two lugs (44,45) and a lock (30) with hooks (39,39') that engage the hooks on the cap. The lugs on the casing fit in between the lugs on the cap, and the drive member has a sleeve (31) at its cap-engaging end with a socket (32) shaped to receive the central boss (13).

4 Claims, 6 Drawing Figures

FAIL-SAFE ELECTRICAL CONNECTION TERMINAL AND TIGHTENING TOOL

The invention relates to a fail-safe electrical connection terminal intended, in particular, for connecting electric cables of large cross section.

BACKGROUND OF THE INVENTION

Generally speaking, a terminal block includes at least one terminal constituted by a bolt which is made U-shaped by a slot through which the conductor is passed. The conductor is then tightened against the end of the bolt, or against a connection strip, by means of a shoe which slides between the branches of the slotted bolt. When the terminal block includes a plurality of terminals e.g. two or four, the connection strip serves to interconnect them. The shoe comprises the end of a rod which is slidably mounted in a hole in the end of a bell-shaped, tapped cap. A compresion spring is interposed between the head of the rod and the cap which is fitted over it, and which compresses it when the cap is screwed onto the bolt. The terminal block generally includes two insulating cheek peices that are at least as long as the bolt/cap assembly when screwed together. The cheek pieces thus serve to protect the terminal(s) of a terminal block against the danger of short circuits by contact with a terminal, and also make it impossible to use a pair of pliers to screw or unscrew the cap by gripping the body of the cap, or by gripping the top of the cap which usually includes tightening means intended to cooperate with a special spanner or key. Such terminal blocks do not, however, prevent a cap from being screwed on using a key, and the key being removed before the conductor has been properly clamped, where an operator is interrupted in the middle of the job, for example.

Preferred embodiments of the invention provide an electrical connection terminal which positively ensures proper clamping of the electrical conductor.

SUMMARY OF THE INVENTION

The invention provides a fail-safe electrical connection terminal comprising: a slotted bolt for receiving an electrical conductor; a tapped cylindrical cap for screwing onto the bolt to clamp the conductor therein, said cap being closed at one end by a plate having a central hole; a shoe for applying the clamping force to the conductor; a rod having one end integral with the shoe and being slidably mounted in said hole in the plate; and a compression spring interposed between the shoe and the plate of the cap, said shoe and spring being housed inside the cap; wherein the plate of the cap includes tightening means in the form of two lugs projecting perpendicularly from the periphery of the plate, and a boss projecting from the center of the plate, said boss having two plane faces located facing the spaces in between the lugs and two hooks, one against each of said plane faces, the end of said central boss projecting beyond the ends of the hooks and being of polygonal shape with said two plane faces being capable of being received in a tool for tightening the cap.

The invention also provides a tool for tightening a connection terminal as defined above, said tool comprising a torque limiter, a hollow casing and a drive member passing through the casing and made fast to the torque limiter, the drive member comrising a sleeve having a polygonal socket of the same shape as the polygonal end of the central boss of the cap, the casing being made fast to a fixed portion of the torque limiter, and having an end equipped with two lugs surrounding the sleeve, and the drive member further comprising a lock having two locking blades each of which ends in a hook, said lugs on the casing fitting in between the lugs on the cap and the hooks of the lock engaging the hooks of the cap.

BRIEF DESCRIPTION OF THE DRAWINGS

An embodiment of the invention is described by way of example with reference to the accompanying drawings, in which.

DESCRIPTION OF PREFERRED EMBODIMENT

Figure 1:
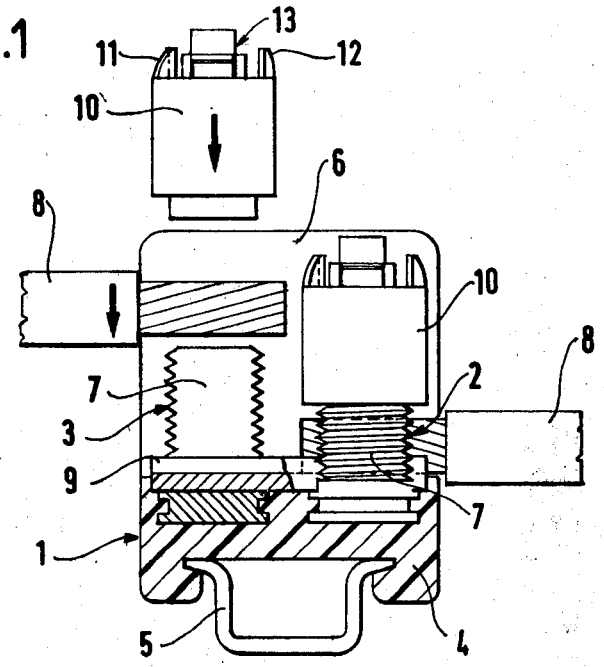
FIG. 1 is an elevation in partial section of a terminal block fitted with terminals in accordance with the invention.

FIG. 1 is a partial section through a terminal block 1 fitted with terminals in accordance with the invention. The block comprises an insulating support 1 mounted on a rail 5, and two terminals 2 and 3 whose lower ends are held fast in the block which includes two check pieces, only one of which, referenced 6, is visible in the figure. Each terminal comprises a U-shaped slotted bolt 7 for receiving a conductor between its two branches, and a tapped cylindrical cap 10 which screws onto the thread on the outside of the bolt 7. The top of the cap is closed and has two lugs 11 and 12, together with a central boss 13 which receives a tightening tool. The two slotted bolts are interconnected by a connection strip 9.

Figure 2:
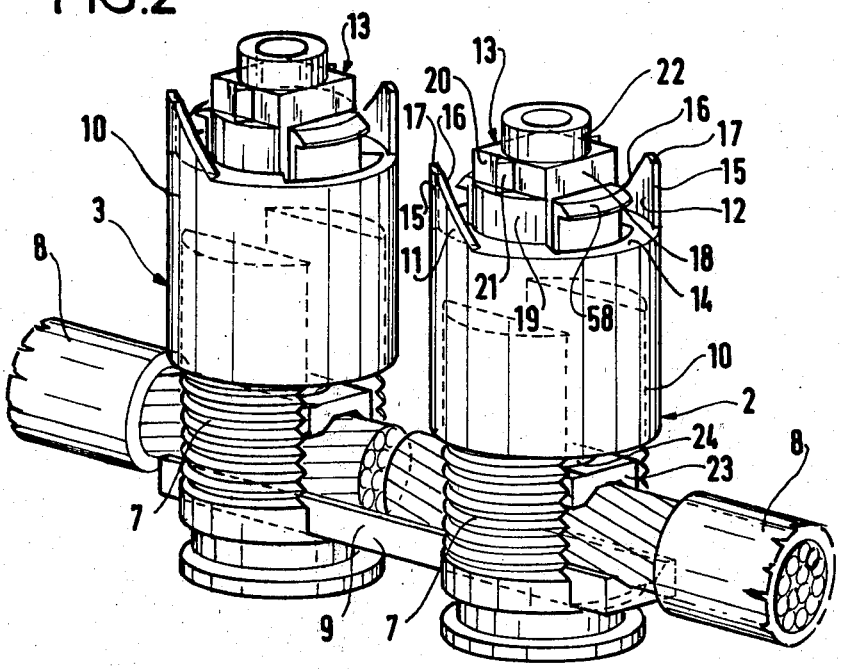
FIG. 2 is a perspective view of terminals from the block of FIG. 1.

FIG. 2 is a perspective view of the terminals of the terminal block shown in FIG. 1. The top of each cap is closed by a circular plate 14. The lugs are diametrically opposed about the centre of the plate 14 and are situated at its periphery. Each lug has a vertical edge 15 perpendicular to the plate and a sloping edge 16. The vertical and sloping edges are joined by a flat 17. The vertical edges 15 of the lugs 11 and 12 are diametrically opposed.

A central hole runs through the full height of the central boss 13 which has two diametrically opposed plane faces 18, only one of which is visible in the figure. The diameter of the plate 14 which is perpendicular to the two plane faces is at an angle of 45° clockwise from the diameter passing through the vertical edges 15 of the lugs 11 and 12. In between its plane faces 18, the central boss has two part cylindrical portions 19 of lesser height than the plane faces 18. Above each part cylindrical portion there is a plane portion 20 with a spigot 21, e.g. of triangular shape, projecting therefrom. The combined height of the part cylindrical portions 19 and the adjacent plane portions 20 is equal to the height of the plane faces 18. The two plane portions 20 and the two plane faces 18 make up a quadrilateral, e.g. a square. Above the quadrilateral the central boss 13 ends in a hollow cylinder 22. The terminal also includes a shoe 23 and a compression spring 24 housed inside the body of the cap 10. A hook 58 is located on each of the plane faces 18 up to the height of the part cylindrical portions 19, and the ends of the hooks 58 slope down towards the plate 14 of the cap 10.

Figure 3:
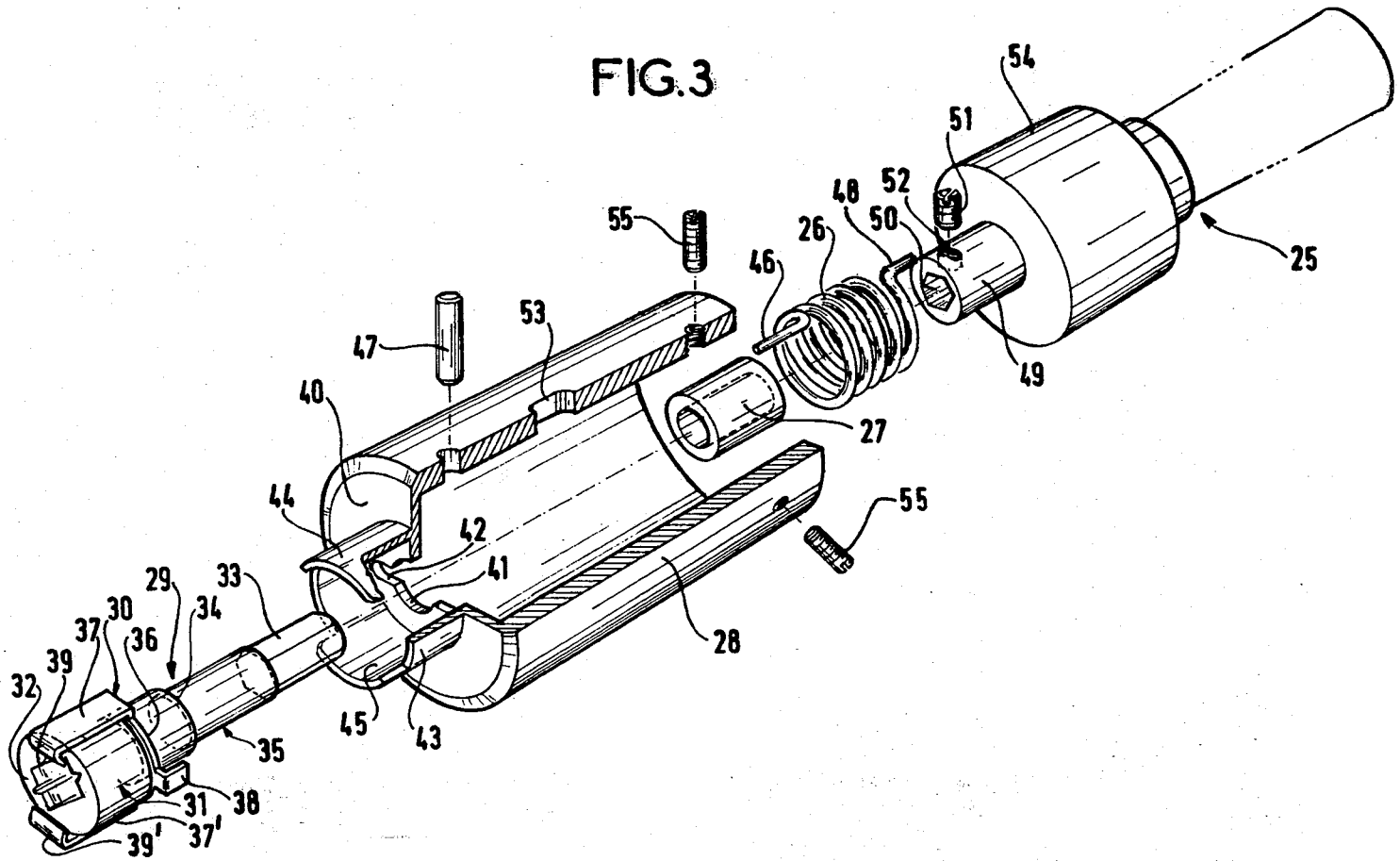
FIG. 3 is an exploded perspective view of a tool for tightening a terminal of the terminal block of FIG. 1.

FIG. 3 is an exploded perspective view of a tightening tool comprising a torque limiter 25, a return spring 26, a spacer 27, a cylindrical casing 28, a drive member 29, and a lock 30. A cylindrical sleeve 31 at the end of the member 29 has a socket 32 shaped to receive the quadrilateral on the central boss 13 comprising the two plane faces 18, the plane portions 20 and the spigots 21. The sleeve 31 is extended by a shaft 35 whose other end 33 is hexagonal. A flange 34 on the shaft 35 serves as an end stop for the spacer 27. The lock 30 is constituted by a ring 36, two locking blades 37 and 37', and two tabs 38, only one of which is visible in the figure. The tabs 38 and the locking blades 37 and 37' are spaced around the ring which is threaded over the shaft 35 with the tabs 38 pointing along the shaft 35 and with the locking blades extending along the sleeve 31. The blades end in respective hooks 39 and 39' directed inwardly towards the socket 32.

The cylindrical casing 28 is closed at one end by a wall 40 having a central hole 41 with a slot 42. The wall 40 supports a cylindrical tube 43 of the same diameter as a terminal cap 10. The length of the slot 42 is less than the diameter of the tube 43. The tube 43 is extended by two identical diametrically opposed lugs 44 and 45, each of which occupies one fourth of the circumference of the tube 43 and extends over a distance at least as long as the height of the lugs 11 and 12 on the cap 10. The drive member 29 has its shaft 35 threaded into the casing 28 via the hole 41 with the tabs 38 of the lock 30 engaged in the slot 42, thereby holding the lock in a specific position relative to the casing 28. The spacer 27 is then threaded onto the shaft 35 via the open end of the casing 28, as is the return spring 26 which then surrounds the spacer 27. One end 46 of the return spring presses against a peg 47 which is mounted on the casing 28 near to the wall 40. The other end 48 of the return spring presses against a screw 51 for fastening the drive member 29 to the torque limiter 25. The torque limiter has a cylindrical sleeve 49 with a hexagonal bore which receives the hexagonal end 33 of the drive member, and the screw 51 is screwed into a tapped hole 52 in the sleeve 49 to secure the drive member 29 in the sleeve 49. The casing 28 has a hole 53 to give access to the screw 51. The casing is then fastened to a cylindrical body 54 of the torque limiter 25 by means of screws 55, in such a manner that the socket 32 in the drive member 29 is in a specific position relative to the lock 30, and hence relative to the lugs 44 and 45 of the casing 25.

Figure 4:
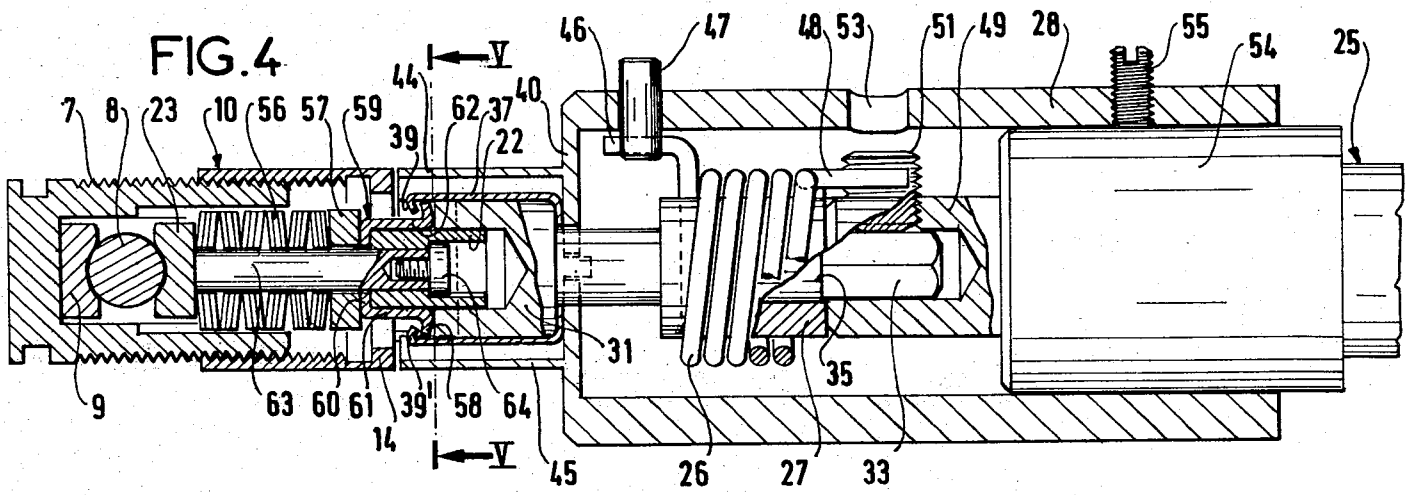
FIG. 4 is a longitudinal section through a terminal and the tool for tightening it, locked together in the rest position.

FIG. 4 is a longitudinal section through a terminal locked to a tool for tightening the terminal. The references on this figure naturally have the same meanings as the references in the previous figures.

In this figure the compression spring 24 of the terminal is constituted by a stack of washers 36 located between the shoe 23 and a spacer 57. The hooks 58 of FIG. 2 are parts of a hooking member 59 which is in the form of a ring 60 with two lugs 61 and 62 having folded over ends projecting therefrom. The hooking member 59 is threaded over a rod 63 which is integral with the shoe 23. The other end of the rod 63 is slidably engaged in the central boss 13 and includes a tapped bore which receives a screw 64 whose head bears against a shoulder located inside the central boss. When a conductor 8 is clamped by screwing down the cap 10, the washers 56 are compressed and the rod 63 slides in the central boss. Once clamping torque has been reached, the head of the screw 64 rises flush with the end of the central boss, which end is constituted by the hollow cylinder 22 shown in FIG. 2. In FIG. 4 the terminal and the tool for tightening it are locked together. The sleeve 31 bears against the part cylindrical portions 19 of the central boss (see FIG. 2), and the hooks 58 of the terminal are engaged in the hooks 39 and 39' of the lock 30 on the tool. The socket 32 in the sleeve 31 (see FIG. 3), is in engagement with the central boss 13, and the lugs 44 and 45 on the casing 28 are located in between the lugs 11 and 12 of the cap 10. The distance between the wall 40 of the casing 28 and the plate 14 of the cap 10 is slightly greater than the length of the tube 43 and its lugs 44 and 45 on the casing 28.

Figure 5:
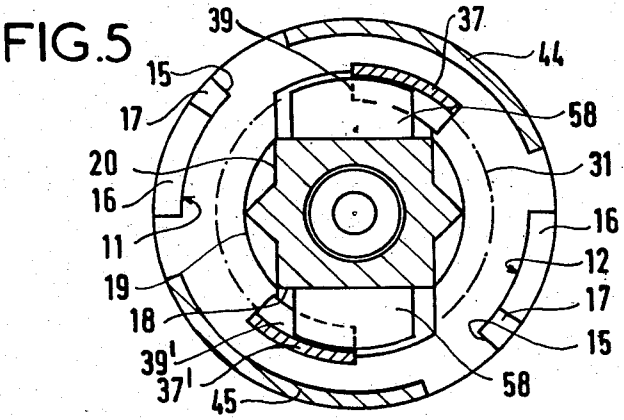
FIG. 5 is a cross section along a line V—V of FIG. 4 to a larger scale, showing the relative positions of the terminal and the tool when locked together.

FIG. 5 is a cross section, on a larger scale, along line V—V of FIG. 4, and shows the respective positions of the terminal and the tool for tightening it when they are locked together. More precisely, it shows the positions of the central boss 13, the hooks 58, and the lugs 11 and 12 on the cap 10 relative to the sleeve 31, the locking blades 37 and 37', and the lugs 44 and 45 on the tool. This figure shows the position of the tool while it is locked to the terminal, a position which it retains during tightening until it reaches a limiting torque set by the torque limiter, as is described below.

Figure 6:
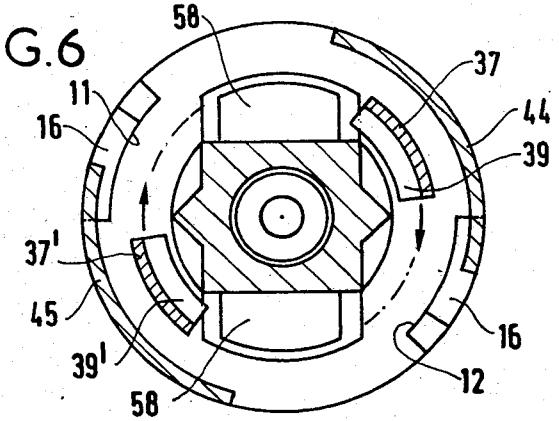
FIG. 6 is a cross section in the same plane as FIG. 5, showing the terminal and the tool once the tightening torque has been reached.

FIG. 6 is a section on the same plane as FIG. 5 showing the respective positions of the cap 10 and the sleeve 31 once the tightening tourque has been reached, in which position the tool may be disengaged.

To screw a cap 10 onto a slotted bolt, the cap is fixed on the end of the tool in the position shown in FIG. 5.

The drive member 29 in the tool (see FIG. 3) is mounted in such a manner that the hooks 39 and 39' are shifted relative to the socket 32. The socket 10 and the tool are brought together so that the hooks 39 and 39' are above the hooks 58 of the cap 10, as shown in FIG. 5. The quadrilateral on the cap's central boss 13 engages in the socket 32. By simply pressing on the cap 10 the hooks 39 and 39' slide over the hooks 58 which slope down towards the cap, and by virtue of the resilience of the locking blades 37 and 37', the hooks 39 and 39' snap back underneath the hooks 58. The lugs 44 and 45 are displaced relative to the vertical edges 15 of the cap's lugs 11 and 12. The cap 10 can no longer be removed from the tool, except by holding the cap with pliers and turning the tool clockwise (the assumed tightening direction). Once the tightening torque has been reached, the tool and the cap take up the positions shown in FIG. 6, from which it can be seen that the hooks 58 and 39 or 39' are no longer engaged. The lugs 44 and 45 of the tube 43 are in contact with the sloping edges 16 of the lugs on the cap, and further rotation in the clockwise direction disengages the tool from the cap. The drive member 29 of the tool is no longer driven by the tool once the tightening torque is reached, so that only the casing 28 rotates, with the sleeve 31 staying in contact with the cap until the tool disengages. When the casing 28 turns through an angle relative to the drive member 29, the return spring 26 in stretched, so that when the tool is disengaged from the cap, the return spring returns the drive member 29 to its normal position, i.e. the position in which no torque is applied to the drive member since the tool is at rest.

When a cap is to be screwed onto a terminal, the procedure is as described above for attaching a cap to the tool, the cap is then screwed onto the slotted bolt of the terminal, and once the torque set by the torque limiter is reached, the tool disengages from the cap as described above.

To unscrew a cap from a terminal, the tool is attached to the cap as before, and the lugs 44 and 45 on the casing 28 come into contact with the vertical edges 15 of the lugs 11 and 12 on the cap 10 only if a large force is applied. The cap 10 is then moved by the tool in an anti-clockwise direction, and the untightening couple is not limited since the casing 28 can only turn through a restricted angle relative to the drive member 29 before it engages the vertical edges 15. This ensures that it is possible to unscrew a cap even if the screw thread has oxidised. After being unscrewed, it will be observed that the cap remains locked to the tool, which provides a safety factor for the connection since the tool cannot easily be disengaged from the tool without the cap being properly screwed home again. Any interruption in the procedure is thus of little consequence since the tool remains locked to the cap, and once the tool is released, it is certain that the cap has been tightened to the proper torque.

Two spigots 21 on the faces 20 of the central boss 13 are shown in FIGS. 2, 5 and 6. The purpose of the spigots is to prevent the use of any tool other than the special tightening tool, e.g. a box spanner of square section. This precaution is taken to increase the safety factor of the connection by making it essential to use the special tightening tool described.

In the embodiment described, the central boss 13 and the socket 32 of the tightening tool are of quadrilateral section, and in particular they are square. Naturally any other shape could be used, and in particular, any shape for which spanners or keys are not commercially available. For example a rectangular or other polygonal shape (regular or otherwise) could be used, without it then being necessary to provide one or more of the faces with spigots or the like.

We claim:

1. A fail-safe electrical connection terminal comprising: a slotted bolt for receiving an electrical conductor; a tapped cylindrical cap screwed onto the bolt to clamp the conductor therein, said cap being closed at one end by a plate having a central hole; a shoe for applying the clamping force to the conductor; a rod having one end integral with the shoe and being slidably mounted in said hole in the plate; and a compression spring interposed between the shoe and the plate of the cap, said shoe and spring being housed inside the cap; the improvement wherein the plate of the cap includes tightening means comprising two circumferentially spaced lugs projecting perpendicularly from the periphery of the plate, and a boss projecting from the center of the plate, said boss having two plane faces facing the spaces in between the lugs and having two hooks, one against each of said plane faces, the end of said central boss projecting axially beyond the ends of the hooks and being of polygonal shape with said two plane faces being capable of being received in a tool for tightening the cap.

2. A fail safe connection terminal according to claim 1, wherein the lugs are diametrically opposed with each of them having an edge perpendicular to the plate, a sloping edge and a flat interconnecting said edges, and wherein the polygonal end of the central boss is a rectangle with two opposite faces constituted by the plane faces of the central boss, and a mid line through the plane faces at an angle of 45° in a clockwise direction from the diameter of the plate which passes through the perpendicular edges of the lugs.

3. A connection terminal according to claim 1, wherein the lugs are diametrically opposite each other, wherein each has an edge perpendicular to the plate, a sloping edge and a flat interconnecting said edges, the lugs being symmetrically arranged about the centre of the plate, and wherein the polygonal end of the central boss is square with the mid line of the plane faces constituting two opposite sides being at an angle of 45° in the clockwise direction from the diameter which passes through the perpendicular edges of the lugs.

4. A connection terminal according to claim 1, wherein at least one of the sides of the polygonal end of the central boss includes a spigot projecting outwardly thereof.

* * * * *